US011284484B1

(12) United States Patent
Lester

(10) Patent No.: US 11,284,484 B1
(45) Date of Patent: Mar. 22, 2022

(54) LED FIXTURE LIGHTING LEVEL SETTING SYSTEM AND PROCESS

(71) Applicant: Marshall Lester, Northridge, CA (US)

(72) Inventor: Marshall Lester, Northridge, CA (US)

( * ) Notice: Subject to any disclaimer, the term of this patent is extended or adjusted under 35 U.S.C. 154(b) by 0 days.

(21) Appl. No.: 17/098,934

(22) Filed: Nov. 16, 2020

(51) Int. Cl.
*H05B 45/10* (2020.01)
*H05B 47/17* (2020.01)
*H05B 47/19* (2020.01)

(52) U.S. Cl.
CPC ..... *H05B 45/10* (2020.01); *H05B 47/17* (2020.01); *H05B 47/19* (2020.01)

(58) Field of Classification Search
CPC ..... H05B 45/10; H05B 47/19; H05B 47/17
See application file for complete search history.

(56) References Cited

U.S. PATENT DOCUMENTS

2019/0021149 A1* 1/2019 Knauss ..... H05B 45/44

* cited by examiner

*Primary Examiner* — Daniel D Chang

(57) ABSTRACT

A system for setting the light level in one or more lighting fixtures connected to a control device such as a wall switch or occupancy sensor using only the conventional power wires. The conventional switch is used to turn power on and off to controlled circuits but also to send level setting sequences to special modules installed in the lighting fixtures and connected to the conventional 0-10V dimming connections. The special modules are connected only to the low voltage 0-10V dimming connections with no connections to the power line or neutral circuits.

19 Claims, 12 Drawing Sheets

FIG 8A LEVEL SETTING PERIOD – NO CHANGE, LEVEL=80%
SECONDS SINCE START LEVEL SET PROCEDURE – 3RD TURN ON
0 5 10 15 20 25 30 35 40 45 50 55 60 65 70 75 80
100%
80%
65%
50%
35%
20%
10%
OFF
160
162
164
166
170
172
174
176
178
180
182
184
188

AC SWITCH POWER TO FIXTURE
ON
OFF
138
184
186
188
190

LED FIXTURE LIGHTING LEVEL SETTING SYSTEM AND PROCESS

CROSS REFERENCE TO RELATED APPLICATIONS

Not Applicable

FIELD OF INVENTION

The invention relates generally to an apparatus which enables the remote control of one or more lighting fixtures to multiple levels or continuous dimming by means of a conventional on/off wall toggle switch that is used to both control the power to the lighting fixture and to send signals to the fixture to change the lighting level.

FEDERALLY SPONSORED RESEARCH

Not Applicable

COMPUTER PROGRAM LISTING

There is no computer program listing appendix that includes the source code for the receiving module.

BACKGROUND

For over the past 100 years, in the commercial and industrial environment, simple on/off switches have been used to control lighting fixtures. The most common form of the switches is that of a toggle switch mounted in a conventional wall box on the wall where power enters the box from a circuit breaker panel and power exits the box to power one or more lighting fixtures. Inside of the box is the toggle switch that is controlled by the user. Typical use would be a manual control that can turn the fixtures on or off. This method was put in place over 100 years ago as the primary method of controlling incandescent light bulbs. That method is still the primary method used commercial on/off control.

For commercial uses much of the lighting in the US is 277 VAC. The lighting source may be florescent, induction, HID or LED. For all standard voltages in the US and worldwide the simple toggle on/off switch is the primary means of lighting control.

For commercial lighting the standard dimming method is called 0-10V dimming which uses a low voltage DC control signal to cause dimming that is controlled by the ballast or driver for the light source. Almost all new LED fixtures can be purchased with 0-10V dimming control.

All conventional lighting wall-box type switches, or occupancy sensors or timers have some sort of switching device between the power into the device and the power out of the device. This switching device is almost always a conventional mechanical toggle switch or mechanical power relay.

There are some wall-box type dimmers designed to control 0-10V fixtures that have low voltage wires that must be connected to the low voltage 0-10V input wires inside of all the fixtures. have any mechanism to change the lighting level of the controlled fixtures. This is a very reliable straightforward solution but the low voltage wires must be run from the 0-10V dimmer to all of the fixtures to be controlled. This can be expensive or impossible depending on the situation. Some building codes require that the low voltage 0-10V wires be run in separate conduit than the 120V, 230V or 277 VAC power wires.

All conventional lighting wall-box type switches, or occupancy sensors or timers turn the power to the fixtures ON and OFF, almost always with toggle switches or mechanical power relays as the power control switch. There are many advantages to using conventional toggle switches or devices with mechanical power control relays to control the load circuits.

1) They are inexpensive
2) They can completely and safely isolate the timer circuitry from the load lines
3) They can control power from other phases that are different from the power that powers the timer circuits
4) They can be supplied in a wide range of voltage and current ratings to meet the needs of the timer use
5) They are robust and immune from problems with powerline noise and disturbances One characteristic of simple toggle switch lighting control is that they can only turn the power ON (100%) or OFF (0%) to a fixture or group of fixtures on a circuit. There is currently no method that a simple toggle switch set a fixture to any level other than ON or OFF. There is no means for one simple toggle switch to set a fixture to 50% lighting level.

There are many complex lighting control systems such as DALI that incorporate additional low-voltage control wires that must be run to the fixtures to send the level-setting signals to special modules or drivers installed in the fixtures. The disadvantage of these systems is the increased cost of the control circuits and the cost to design and run special low-voltage control wires to every fixture to be controlled. There are also many other changes necessary to the dimmer pcb layout and power supplies. Often special repeaters must also be installed in order to insure reliable communication between the timer and the modules that must be installed in the lighting fixtures. These repeaters can easily cost more that the timer itself.

There are also various wireless control systems such as WI-FI, ZIGBEE and ZWAVE that incorporate special wireless transmitters and receivers in the dimmers and in special receiving modules or drivers in the fixtures to send and receive the dimming and level-setting signals to special modules or drivers installed in the fixtures. The disadvantage of these systems is the increased cost of the transmitting, receiving and control circuits that must be incorporated into both the dimmers and the fixtures. There are also many other changes necessary to the timer pcb layout and power supplies. Often special wireless repeaters must also be installed in the system in order to insure reliable communication between the timer and the modules that must be installed in the lighting fixtures. These repeaters can easily cost more that the dimmers and fixtures.

There are also systems that have complex powerline communications such as PulseWorx and SimpleWorx by Powerline Control Systems and Insteon by Smart Home that are also capable of dimming and changing the lighting level in lighting fixtures. Adding these communications circuits to conventional dimmers also requires many other changes necessary to the dimmer pcb layout and power supplies. Often special powerline communication repeaters must also be installed in order to insure reliable communication between the timer and the modules that must be installed in the lighting fixtures. These repeaters can easily cost more that the dimmers and fixtures.

BACKGROUND OF THE INVENTION—OBJECTS AND ADVANTAGES

Accordingly, several objects and advantages of the present invention are:

- to provide a simple reliable device for setting a fixed lighting level(s) to all 0-10 v fixtures using a zener diode to set the dim voltage so the voltage will be relatively constant no matter what the output impedance is of the 0-10 v diver selected, which may vary from an output current of >100 uA to >3 mA.
- to provide a method whereby conventional toggle switch can meet the dimming and multi-level lighting requirements of California 2103 Title 24 Standards.
- to provide a method whereby conventional toggle switch can dim or control lighting loads to multiple levels while causing no additional cost to the costs of a conventional wall box toggle switch.
- to provide an inexpensive, reliable method of sending messages from conventional toggle switches to small inexpensive 0-10V receiving modules that can be installed in lighting fixtures when and if needed.
- to provide simple small inexpensive controllable level setting modules that can be installed in any fixture that uses conventional 0-10V ballasts or 0-10V drivers and thereby set the lighting level of said 0-10V drivers when and if needed.
- to provide simple small inexpensive controllable level setting modules that is capable of powering it's internal logic and circuits using only power derived from LED drivers 0-10V input control wires.
- to provide simple small inexpensive controllable level setting modules that have no other physical or wireless input or connection other than the two connections to the LED driver 0-10V input control wires.
- to provide a method whereby simple level setting modules that do not need to incorporate any line voltage connection to set the lighting level of standard 0-10V lighting drivers or ballasts
- to provide a method whereby simple level setting modules that do not need to incorporate any line voltage primary control that can be installed in any fixture using conventional 0-10V ballasts or LED drivers and control the level of those 0-10V ballasts or LED drivers
- to provide conventional toggle switch installations capable of controlling lighting fixtures to multiple lighting levels yet can be used in the conventional manner to turn fixtures ON and OFF in the absence of said fixtures incorporating 0-10V dimming ballasts or LED drivers or such drivers equipped with receiving modules
- to provide adaptive level setting modules that can be installed in any fixture equipped with standard 0-10V drivers that quickly and easily connect to only the two 0-10V wires and is capable of receiving commands from the conventional toggle switch in the wall box then outputting the user selectable level signal on the 0-10V wires to set the fixture or set the desired lighting level
- to provide adaptive level setting modules that can be installed in any fixture equipped with standard 0-10V drivers that are capable of receiving commands from the conventional toggle switch with no programming, linking or setup or commissioning by the installer or pre-programming at the factory
- to provide adaptive level setting modules that can be installed in any fixture equipped with standard 0-10V drivers that are capable of receiving commands from the conventional toggle switches that can be produced and used correctly that require no human interface such as pushbuttons or LED indicators
- to provide adaptive receiving modules that can be installed in any fixture equipped with standard 0-10V drivers that are capable of receiving commands from the conventional toggle switch that can be produced and used correctly that require no primary line voltage connection wires, but ONLY the 0-10V wires because the primary ON/OFF control is provided by the conventional toggle switch located in the wall box
- to provide adaptive level setting modules that are small enough to be installed in any fixture even fixtures with the most limited space available
- to provide adaptive level setting modules that are small enough and light enough to be installed in any fixture by only the wire connections with NO other mounting method necessary
- to provide adaptive level setting modules that can be installed in any fixture equipped with standard 0-10V drivers that are capable of receiving commands from a conventional toggle switch and that can ONLY receive signals from the toggle switch to which it is directly connected and cannot possible receive any command or communication signals from any other wall box toggle switch, dimmer, timer or occupancy sensor even if that device is located in the same physical proximity or wired directly to the same branch circuit breaker phase or circuit.
- to provide adaptive receiving modules that can ONLY receive signals from $1^{st}$ wall box toggle switch to which it is directly connected and cannot possible receive any command or communication signals a 2nd wall box toggle switch even if the other toggle switch is powered on it's input power connection by the same branch circuit as the $1^{st}$ device or the $2^{nd}$ device is located in the same proximity as the $1^{st}$ device.
- to provide adaptive receiving modules that requires no addressing or linking mechanism- or programming to connect to only one toggle switch as such one-to-one exclusive connectivity is provided for by the fact that the adaptive receiving module is wired and connected directly ONLY to the controlling desired toggle switch
- to provide adaptive receiving modules that requires no wireless receiver or antenna of any kind
- to provide adaptive receiving modules that can be controlled correctly by a toggle switch even if mounted in an entirely enclosed grounded metal fixture
- to provide adaptive receiving modules that can be controlled correctly by a wall box toggle switch without any limitation of the distance between the two as long as a correct power wire of the correct load current capability to provide the proper voltage and current the fixtures require is used, even if the distance exceeds several 1000 feet

SUMMARY OF INVENTION

In order to aid in the understanding of this invention, it can be stated in essentially summary form that it is a specialized power control method to operate conventional toggle switch to send specialized signals to downstream lighting devices and effect changes to different lighting levels or other parameters of the lighting such as the color spectrum of the lights. Also one version of fixed level control can be implemented that uses a fixed zener level without the ability of changing the level using a toggle switch.

Also described is a specialized receiving device connected to the 0-10V input of any LED driver capable of receiving said signals and setting the lighting level of 0-10V equipped lighting fixtures.

These embodiments or parts of the embodiments can be listed as:

1. Level Setting Module with level setting 0-10V output connections to be connected to 0-10 VDC LED driver input connections
2. Level Setting Module with LED Color Tuning Output or Outputs
3. Fixed level control can implemented using a fixed zener diode
4. Fixed control with multiple levels implemented using a set of switched zener diodes 1) Level Setting Module with 0-10V Outputs Simple electronic module that can control the lighting level of a lighting fixture when connected only to the 0-10V inputs, where the power to said lighting fixtures are controlled by simple ON/OFF wall switches or toggle switches. The Level Setting Module requires NO connections to line or neutral or load wiring, and does not need any internal primary ON/OFF power control relay or switch.

2) Color Tuning Module with LED Color Tuning Output or Outputs

This embodiment of the invention is in the form of a LED driver controller where the method of this invention is in the form of a module with the ability to output control signals capable of change the color tuning of the LED driver.

3) Fixed Level Control can Implemented Using a Fixed Zener Diode

Simple electronic module that can control the lighting level of a lighting fixture when connected only to the 0-10V inputs, where the power to said lighting fixtures are controlled by simple ON/OFF wall switches or toggle switches. The Level Setting Module requires NO connections to line or neutral or load wiring, and does not need any internal primary ON/OFF power control relay or switch. With only one fixed level set by one zener diode to minimize expense and complexity 4) Fixed Control with Multiple Levels Implemented Using a Set of Switched Zener Diodes Simple electronic module that can control the lighting level of a lighting fixture when connected only to the 0-10V inputs, where the power to said lighting fixtures are controlled by simple ON/OFF wall switches or toggle switches. The Level Setting Module requires NO connections to line or neutral or load wiring, and does not need any internal primary ON/OFF power control relay or switch. With several fixed levels set zener diodes set by simple switches to minimize expense and complexity The first basic concept is that the exact same toggle switch, that is used, without any modification, to turn the lighting fixtures on and off, is also used to set the lighting fixtures to different dim levels.

The method used to accomplish this is to use the toggle or other switch as a signaling device to send messages to the special level setting modules installed in the lighting fixtures on the circuit controlled by said toggle or other switch. The messages used in the preferred embodiment of this application consist of a few short openings and closings of the toggle switch in a certain predetermined pattern.

The only single device is small electronic modules that must be installed in the LED fixtures if the multiple light levels functionality is to be achieved. The level setting modules have standard 0-10 VDC outputs, two wires, that care connected to conventional 0-10 VDC control inputs of conventional dimming ballasts or dimming LED drivers. Because of the simplicity and small size these modules can be very small and inexpensive. One key benefit of this innovation is that the toggle switch that controls primary power from the trimer to the lighting fixture is still in the system, and still performs the function of turning ON and OFF the power to the lighting fixtures. This is important for two reasons. One, the toggle switch is already part of all conventional wall switch lighting control designs, so no change is necessary wall switch part of the circuit. And, two, because ON and OFF function is supplied by the toggle switch, then NO ADDITIONAL PRIMARY POWER CONTROL IS NECESSARY IN THE RECEIVING MODULES. Other control modules used in wireless, hard-wired, or powerline communication systems MUST HAVE PRIMARY POWER RELAYS or other switching devices in the receiving modules that are capable of turning the power ON and OFF to the lighting fixture. The small level setting modules that are part of the current invention do not need to supply the primary ON and OFF functionality since that functionality is still provided by the toggle switch. This allows the level setting modules to be much smaller and less expensive and easier to mount and install than any other LED dimming control modules currently on the market.

One significant value of this system is that the wall switch is wired exactly as any other conventional wall switch would be. To retrofit the dimming or level setting functionality in an existing facility there are NO changes required in the wiring or wall switch. There is no need to run additional low voltage 0-10V wires. This is a very significant savings in time and money.

Adding the ability to the same ON/OFF switch used in conventional lighting control to also be able to change the lighting level in the fixtures is extremely valuable. There are new regulatory requirements that mandate that certain fixtures be capable of being dimmed or set to multiple lighting levels such as 100% 50% and Off. There is currently no simple wall switch-based method that can accomplish this functionality.

There are many ways that complex, expensive, sophisticated, powerline communicating or wireless systems can accomplish this goal. The method of this invention requires ABSOLUTELY NO change in the hardware cost, component cost, or assembly cost of conventional wall switches, timers, occupancy sensors and lighting control panels. The only change is the addition of the small level setting module to the fixture. Therefore the cost to add this functionality to existing circuits is very small.

It is true that small inexpensive modules need to be installed in the 0-10V dimmable lighting fixtures in order to complete the functionality, but this step does not need to be completed unless the user chooses to add the multi-level functionality. A part of the value of this innovation is that the relay wall switches, timers, occupancy sensors and lighting control panels can be installed exactly as any conventional relay wall switches, timers, occupancy sensors and lighting control panels without any additional design or programming or thinking, and the dimming and multi-level functionality which may be deemed to be necessary at the current time, can be installed at a later time, at a very small cost.

With complex powerline communicating or wireless systems this goal could be accomplished but the user would have to remove the conventional wall switches and install an expensive new powerline communicating or wireless wall switch in its place. It is much better just to install the version of a toggle wall switch, timer, or occupancy sensor described in this application and add the level setting functionality later if desired. There need be NO wiring or design changes to the existing wall switches, timers, or occupancy sensors and they will control the lighting fixtures with conventional ON and OFF functionality.

Embodiments, examples, features, aspects, and advantages of the present disclosure will become better understood with regard to the following description, appended claims and accompanying drawings.

One might look at the simplicity of this innovation and conclude that the method is obvious, but the fact is that no manufacturer has implemented this innovation over the past 20 years when there is no technical reason this innovation could not have been implemented any time over the past 20 years. Microprocessors and Zener diodes have been all produced by the 1000's of millions yet no one has put this simple combination together in a commercial product, even though the value is tremendous. That is a clear indication that this combination of simple principals and components has not been and is not obvious.

BRIEF DESCRIPTION OF THE DRAWINGS

The foregoing aspects and the attendant aspects of the present disclosure will become more readily appreciated by reference to the following detailed description, when taken in conjunction with the accompanying drawings, wherein:

FIG. 6 LEVEL SETTING MODULE ZENER ONLY CIRCUIT. This

DETAILED DESCRIPTION OF INVENTION

In accordance with embodiments described herein the purpose of the apparatus of this invention as shown in FIGS. 1 to 12 is to enable the control of lighting levels in fixtures connected to what is a conventional wall switch, timer or lighting control panel.

Figure 1:
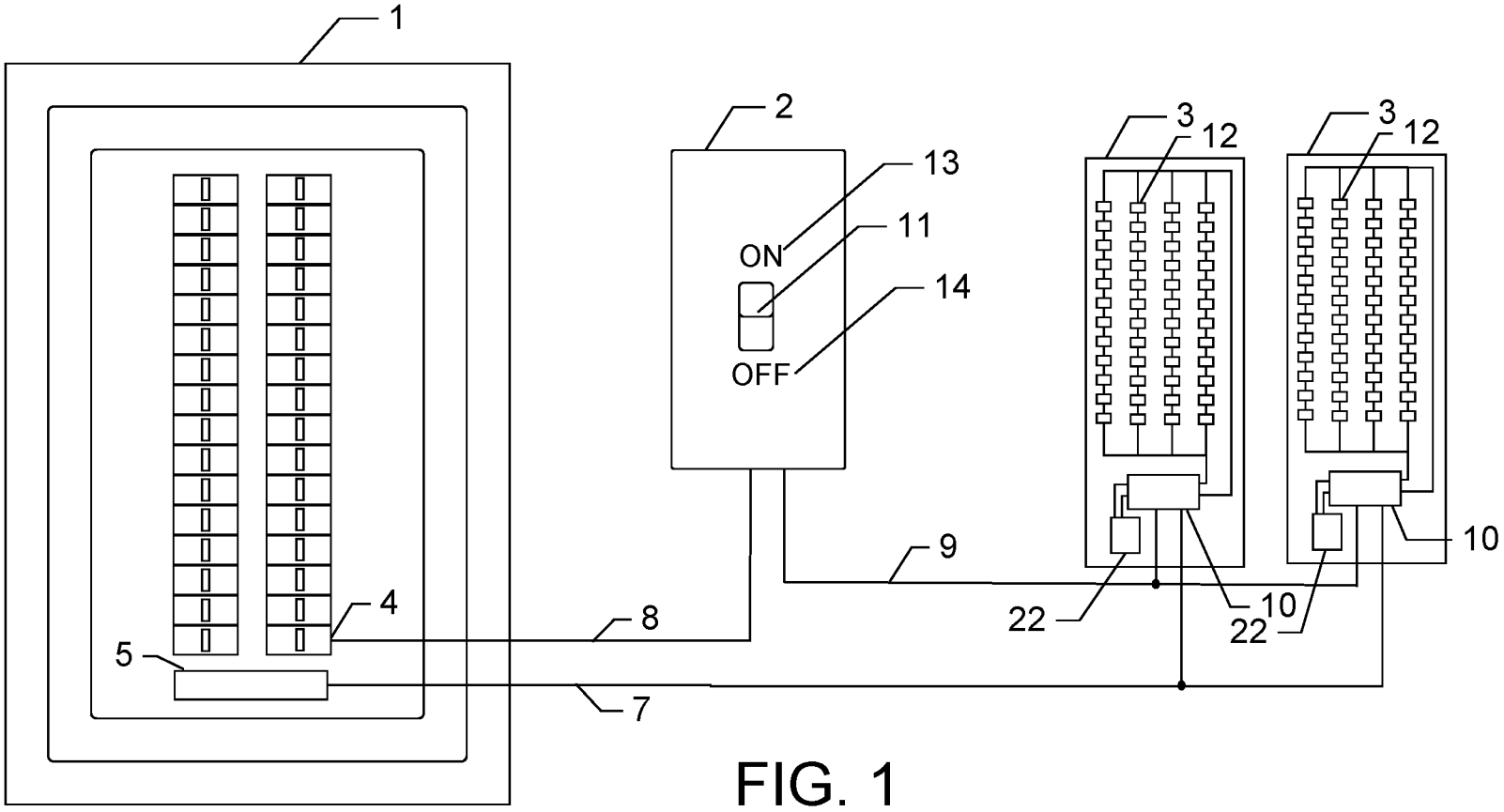
FIG. 1 TYPICAL WALL SWITCH WIRING This figure shows the wiring diagram of typical LED fixtures including the level setting modules. This figure also shows the circuit breaker panel supplying power to the time and two typical lighting fixtures controlled by the wall dimmer.

Conventional Device Wiring FIG. 1 shows a wall-box type switch as it would be connected to turn LED fixtures on and off. The wall switch 2 is powered from a typical circuit 8 connected to a circuit breaker 4 in a circuit breaker panel 1, and also the neutral 7 from the neutral bus 5 in the circuit breaker panel 1. The wall switch has a toggle 11 that has an ON 13 and OFF 14 position. The wall switch 2 is connected to LED fixtures 3 to enable the switch to turn the fixtures on and off. These fixtures all contain conventional 0-10V LED drivers 10 which power the LEDs 12. These figures contain only conventional devices except for the addition of special level setting modules 22 which are shown in all the fixtures 13. These level setting modules receive the "on/off" sequence from the wall switch 2 through the load lines 9 and output 0-10V signals to the LED drivers 10.

A wiring diagram of a conventional wall-box wall switch 2 is shown in FIG. 1. This will be used as an example of an application in this description of this invention. Also shown for clarity in FIG. 1 is the circuit breaker panel 1 powering the wall switch 2, and two lighting fixtures 3 being powered by the wall switch 2. Circuit breaker 4 is powering the switch through circuit 8. Also the neutral bus 5 inside the circuit breaker panel 1 is connected to line 7 which connects to the wall switch 2 and the two fixtures 3.

Shown on the wall-box wall switch 2 are some conventional features of wall-box wall switches such as a toggle switch 12 that has ON 13 and OFF 14 positions.

All of these devices and the connection of those devices, except the level setting modules 22 are very conventional and will be known to anyone in the electrical industry.

All that is shown in FIG. 1 is completely conventional except for the addition of the level setting modules 22 that only connect to the LED driver 10 0-10V connections. A large part of the value of this invention is there are only small changes in conventional timer use that will produce dramatic results that are capable of meeting new multi-level lighting requirements.

Several important aspects of the current invention are:

(a) The wiring of the wall switch and fixtures that is the subject of this invention is IDENTICAL to that of a conventional wall switch to fixture wiring in FIG. 1.

(b) The only physical change necessary to implement multi-level functionality in existing fixtures is to connect a small level setting modules 22 inside the fixtures to the ballast/driver 0-10V input wires. There is no programming, addressing, or setup, necessary.

Preferred Embodiment Wiring in FIG. 1

Figure 2:
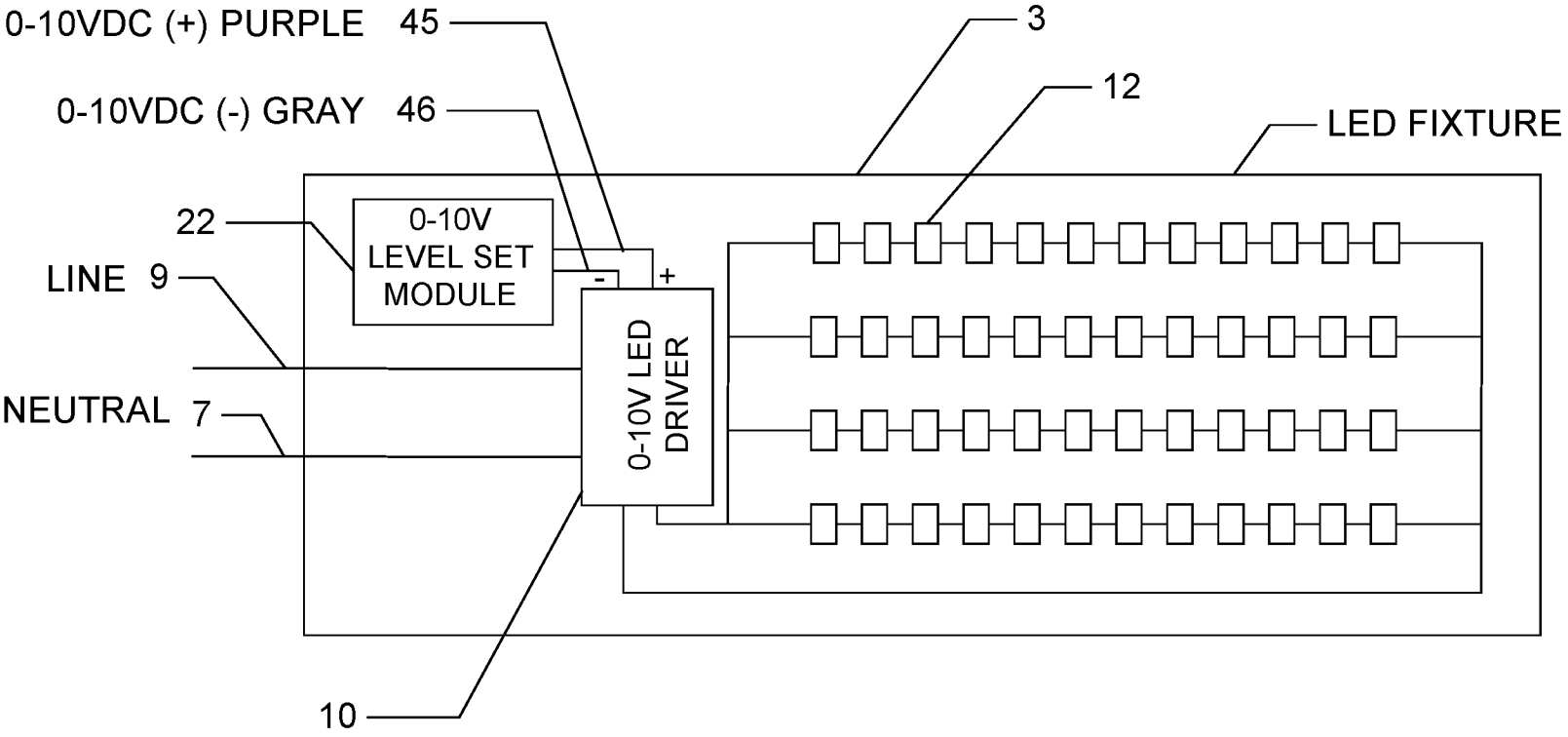
FIG. 2 FIXTURE WIRING WITH 0-10V LEVEL SETTING MODULE INSTALLED IN FIXTURE. Inside the lighting fixture are shown the LED driver that power the LEDs and the special level setting module that provided the multi-level control to the ballast/driver 0-10V input wires.

FIG. 2 Shows complete LED fixture 12 with LEDs 3 connected to 0-10V LED driver 10 inside. Also shown is the 0-10V level setting control module 22 with connections to the 0-10 VDC (+) PURPLE control wire 45 and 0-10 VDC (−) GRAY control wire 46. These wires are usually colored purple 45 and gray 46.

Figure 3:
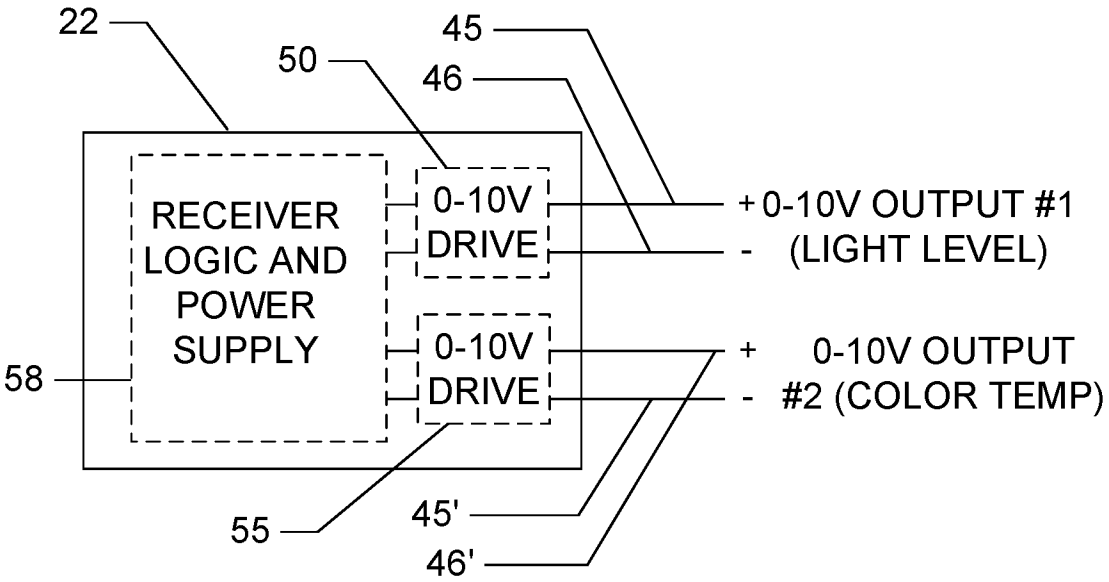
FIG. 3 LEVEL SETTING MODULE WITH MULTIPLE 0-10V OUTPUTS FOR DIM LEVEL AND TEMPERATURE TUNING. This figure shows the wiring diagram of any LEVEL SETTING MODULE that has multiple 0-10V outputs to control a tunable LED fixture with multiple drivers arranged to control the color temperature balance and the dim level. A level setting module can be built to have outputs tailored to the needs of any specific LED driver type. The only difference between this module and the module shown in Figure XX is the addition of a second 0-10V output that could be connected to a separate LED driver that could be connected to two separate strings of LED of different color characteristics. The message structure could easily be modified to add one additional sequence so that the message could control both level setting 0-10V output and color tuning output.

FIG. 3 shows the wiring diagram of any LEVEL SETTING MODULE that has multiple 0-10V outputs to control a tunable LED fixture with multiple drivers arranged to control the color temperature balance. This implementation would require a special driver that has two separate 0-10V inputs where one controls the lighting level and another 0-10V input controls another parameter such as the color temperature. A level setting module can be built to have outputs tailored to the needs of any specific LED driver type. The only difference between this receiving module and the receiving module 22 shown in FIG. 2 is the addition of a second 0-10V output 45', 46' that could be connected to a separate LED driver that could be connected to two separate strings of LED of different color characteristics. The first 0-10V connection 45, 46 is similar to the connection in the other drawings. There would be a section of this multi-output type device that would be microprocessor based with a power supply 58 and one driver circuit 50, 55 for each 0-10V output to be controlled. The control sequence could easily be modified to add one additional step so that the message could control both 0-10V outputs with one message. The current preferred embodiment has only one output to control one 0-10V dim level but the concept can easily be extended to two or more outputs to control two or more functions.

Figure 4:
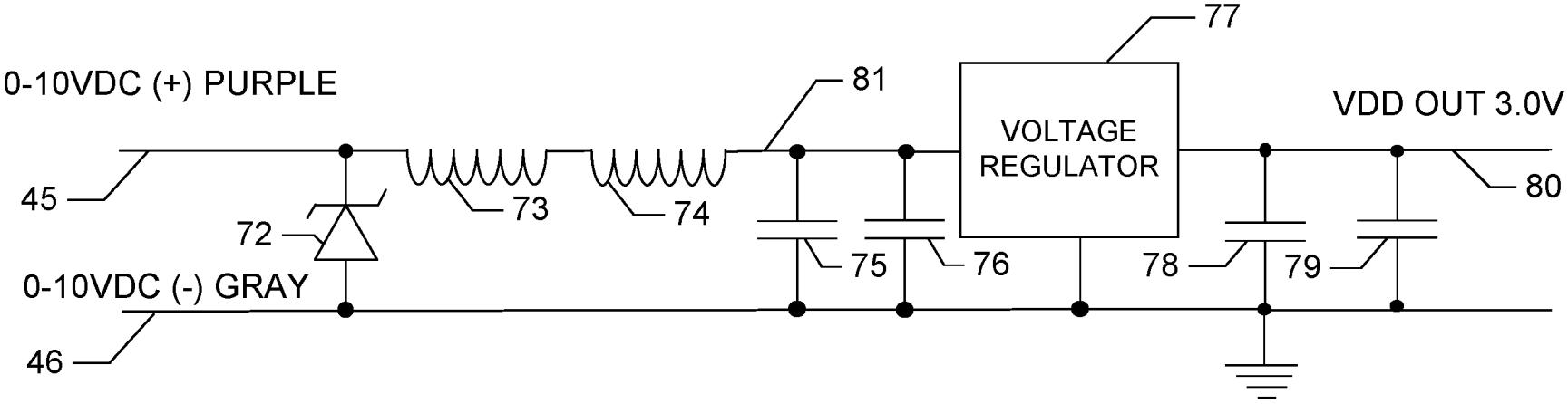
FIG. 4 LEVEL SETTING MODULE POWER SUPPLY. This figure shows the schematic components of the power supply of the level setting module.
Figure 5:
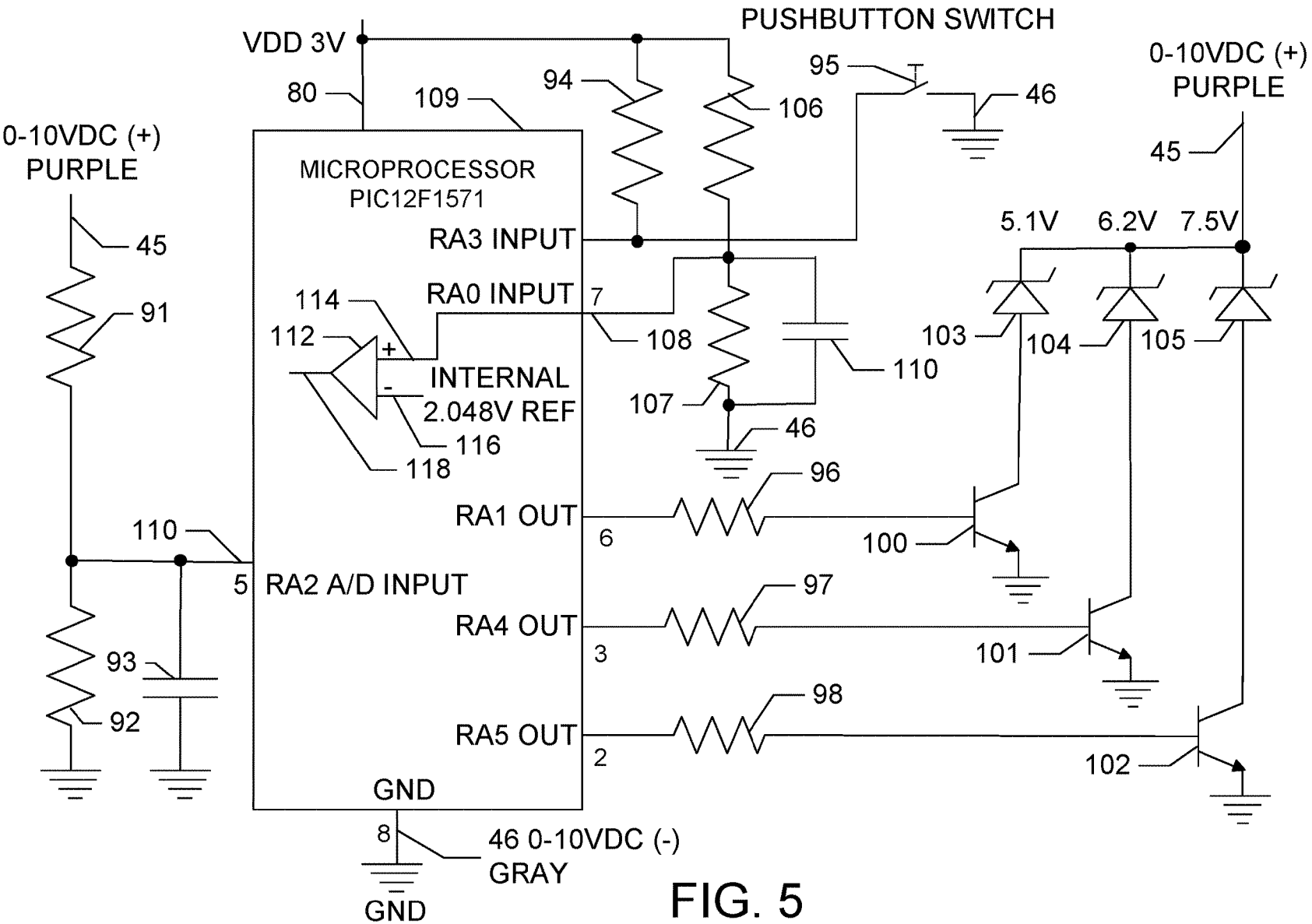
FIG. 5 LEVEL SETTING MODULE MICROPROCESSOR CIRCUIT. This figure shows the schematic components of the microprocessor and zener diode part of the level setting module.

FIGS. 4 and 5 are the schematics of the level setting module 22 that would be installed in the fixtures 3 and enable the user to operate a simple toggle wall switch 2 to change the light levels in the fixtures 3.

The schematic for the level setting module is very straightforward. On FIG. 4 is shown the simple power supply. The power supply is connected to the 0-10 VDC (+) PURPLE control wire 45 and 0-10 VDC (−) GRAY control wire 46 inside the fixture 3. Zener diode 72 clips the input voltage to a safe nominal 11V level and also serves to limit the voltage to 0.7V if the user should accidentally connect the input wires backwards. Inductors 73 and 74 and capacitors 75,76,77 and 78 help block noise from getting to the voltage regulator 77 and microprocessor 109. The outputs of the power supply are a regulated 3.0V 80 and ground 90.

A standard linear voltage regulator 77 reduces the 11V 45 to 3.0 VDC 80 required by the microprocessor 109, shown on FIG. 5.

FIG. 5 shows the microprocessor 109 and various inputs and outputs. Input line 11V from the 0-10 VDC (+) PURPLE control wire 45 input is connected to resistors 91 and 92 which make a voltage divider and input a voltage proportional to the 0-10 VDC (+) PURPLE control wire 45 input into pin 5 of the microprocessor which is an A/D input that can measure the analog voltage of the input. Filter capacitor 93 helps eliminate noise on the input. This is also the input that allows the processor 109 to measure the voltage and change the 0-10 VDC lighting levels using zener diodes 103, 104 and 105. Ground 90 for these circuits is provided by the 0-10 VDC (−) GRAY control wire 46.

The processor 109 can set the 0-10V voltage to 5.1V, 6.2V, 7.5V and 10V by turning on the different zener diodes 103, 104 and 105 respectively. The resistors 96, 97 and 98 are used to turn on transistors 100,010, and 102 to turn on the zener diodes 103, 104 and 105 respectively. The nominal 10V voltage level is achieved be not turning on any of the three zener diodes. This is a very simple and novel method of controlling the 0-10V input level to the four different nominal levels 5.1V, 6.2V, 7.5V, and 10V.

This is a very reliable and novel method of controlling the 0-10V level of all fixtures even though the output impedance of different LED drivers 0-10V connections vary greatly. Some LED drivers can source only 100 uA where some can source several mA. The circuits in this invention can work with LED drivers sourcing 100 uA and also with LED drivers sourcing 5000 uA. Besides being able to set the 0-10V level to the desired level the circuit also has to produce the correct voltage and current so that the microprocessor can operate correctly.

There is a pushbutton switch 95 added to the circuit with a pull-up resistor 94 and a connection to ground 90 so that the user can manually change the levels for testing demonstrations or to simply preset the lighting level before installation. Each time the user taps the pushbutton switch 95 the lighting level changes by one level. The user can easily step through all the levels in a very short time.

The pushbutton switch 95 is also used for two other purposes. If the switch is pressed before and during when power is turned on the level set device will go into a self-test routine that steps through all levels and measures the voltage on pin 5 with the A/D measuring circuit made up of resistors 91 and 92 and capacitor 93. If the voltages are correct the processor will set pin 7 high and if any of the voltages fail the processor will set pin 7 low. In the test apparatus pin 7 is connected to an external LED to indicate the PASS or FAIL test results.

One important part of the design and functionality of the level setting module is that it must reliably detect when the user has turned off power to the light fixture. The level set module 22 is only connected to the two 0-10V wires and therefore cannot sense when power to the fixture on line voltage input 9 from the wall switch 2 has been turned off. One aspect of the level set module that makes it simple to install and makes it not required to meet any UL or ETL line voltage requirements is that there is no line voltage connections. This also introduces a severe problem that must be overcome in order to produce this product. The microprocessor must be able to detect when the module is turned off, but it must detect this before the voltage drops so low that it no longer operates. Internally the processor must record the time at which it is turned off before it stops operating.

The novel method by which this is achieved is by using the comparator 112 to quickly determine that the voltage at point 108 has dropped below the internal reference voltage 116 of 2.048V. As the fixture is turned off the voltage 45 from the LED driver 0-10V input will eventually fall to lower than 3.0V and the voltage at the voltage divider 106, 107 at point 108 will fall from 2.3V to below 2.048V. This will indicate to the microprocessor that the fixture has been turned off.

Resistors 106 and 107 which make a voltage divider and input a voltage of about 2.3V which is proportional to the 3.0V 80 supply voltage to the processor. This divided voltage is input into pin 7 of the microprocessor which is a comparator 112 input 114. The internal comparator has one internal input 116 connected to the 2.048V internal voltage reference and the other input 114 to the external pin 7 114 voltage divider 108 which is nominally at 2.3V when the supply voltage 80 is 3.0V.

The comparator output 118 will change when the voltage supply to the processor is about 2.6V. Since our processor can operate down to 2.0V there is no problem for the processor to record the OFF time before the voltage falls too low for the processor to operate. Why it is so important for the microprocessor to know when the fixture is turned off by the user will be shown in the description as the functionality and operation are discussed. The only input to the level setting module is the time different between when the module was turned on and when it was turned off. This is related to when the fixture was turned on and when the fixture was turned off. These times are not equal because there is a delay between the time when the fixture was turned on or off and when the power at the 0-10V connections goes on or off. To make the problem more complex these delays are different for every different model of LED driver.

Figure 6B:
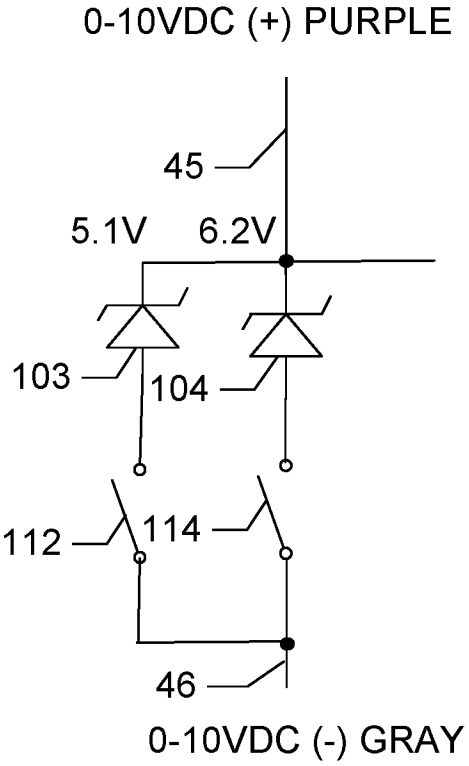
FIG. 6B shows the schematic components of simple fixed level zener diode level setting module with multiple zener diodes selected with simple mechanical switches.
Figure 6A:
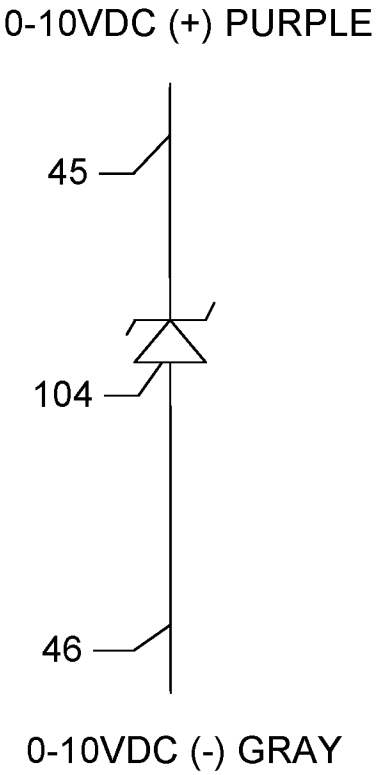
FIG. 6A shows the schematic components of simple fixed level zener diode level setting module. This

FIG. 6A shows a simple fixed voltage level setting circuit consisting only one zener diode 104 connected between the 0-10 VDC (+) PURPLE control wire 45 connection and 0-10 VDC (−) GRAY control wire connection 46.

FIG. 6B shows a two stage voltage level setting circuit consisting two zener diodes 103, 104 connected between the 0-10 VDC (+) PURPLE control wire 45 connection and 0-10 VDC (−) GRAY control wire connection 46. There are switches 112, 114 in series with each zener diodes so the voltage malevel can be set by the user to one of two levels.

To facilitate understanding the operation of the level setting module we will review the operating functionality as it appears to the user to change the level of the fixture.

1) Turn the fixture ON and then OFF after 8 seconds a $1^{st}$ time.
2) Wait at least 8 seconds when the fixture is off, with no maximum time.
3) Turn the fixture ON and then OFF after 8 seconds a $2^{nd}$ time.
4) Wait at least 5 seconds when the fixture is off, with no maximum time.
5) The third, (next) time the fixture is turned on it will enter "program mode". The fixture will cycle through all 4 dim levels changing one level each time every 8 seconds. It will repeat this cycling four times which will take a total of 128 seconds.
6) To change the level the user should turn the fixture off when it is at the desired level.
7) The next time the fixture is turned on it will be set to the new level.
8) If the user lets the fixture cycle through all four levels four times (128 seconds) and never turns the fixture OFF then the fixture will go back to the original level and stop cycling and exit from "program mode".

Figure 7:
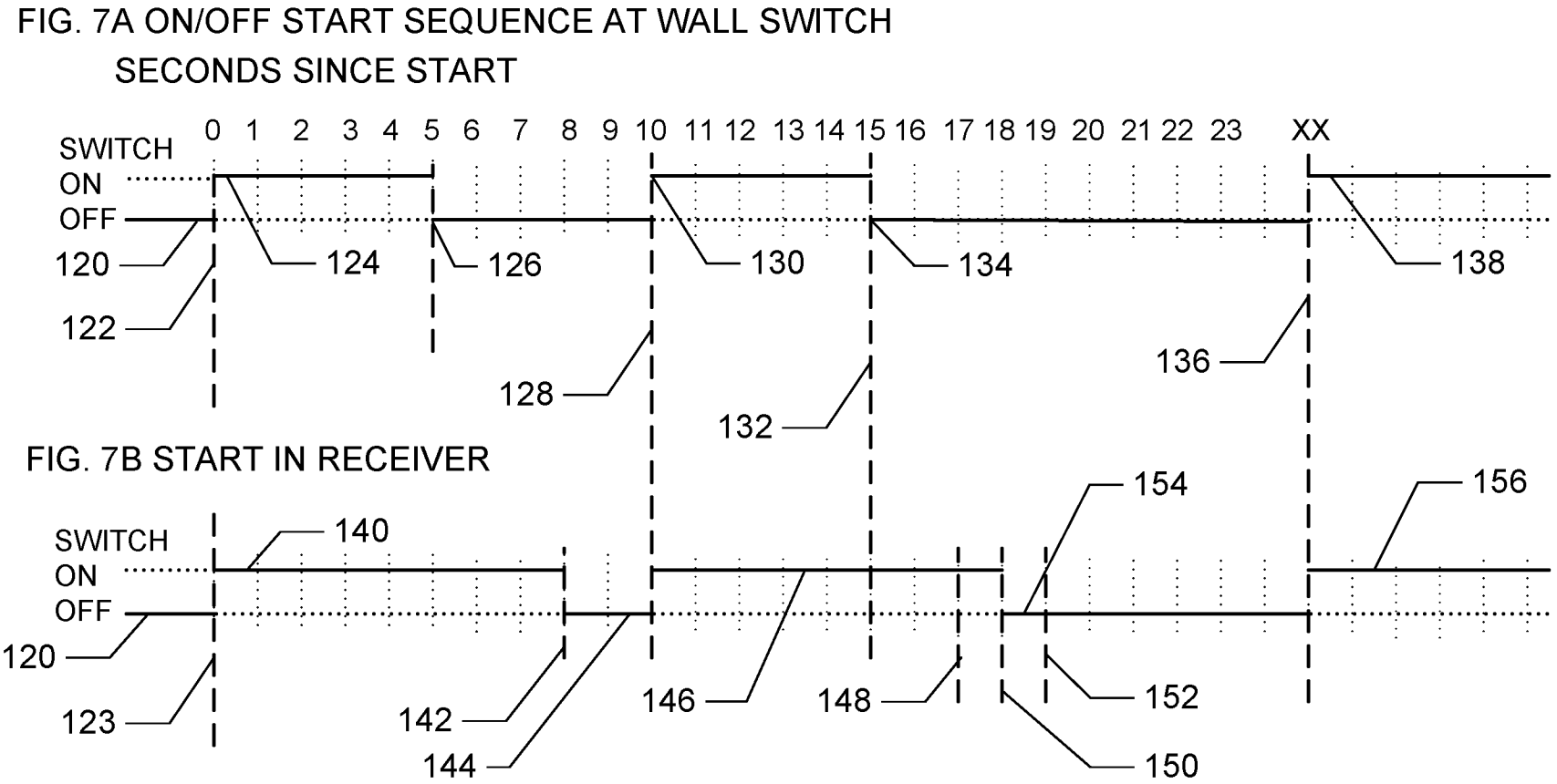
FIG. 7 ON/OFF START SEQUENCE AT WALL SWITCH. This figure shows the wall switch ON and OFF sequence required to get the level setting modules to enter the level setting mode of operation.

FIG. 7 illustrates the operation of the level setting module. FIG. 7A shows the 120 VAC power as applied from the wall switch to the fixtures. FIG. 7B shows the voltage at the 0-10 VDC (+) PURPLE control wire which is supplying the voltage regulator 77 and then to the microprocessor 109 and also to the voltage divider 91, 92 which goes to an A/D input 110 of the processor. When the fixture is OFF the voltage in 7A 120 and 6B 120 is zero. When the switch is turned ON at time 122, 123 both voltages in FIGS. 7A and 7B rise to 124 and 140 respectively. At this point the microprocessor starts recording the ON time. In FIG. 6A the ON time 124 is shown as 5 seconds. At point 126 the user turns the switch OFF and the voltage drops to 0 VAC 126. The user waits 5 seconds and at point 130 turns the switch back ON. After 8 more seconds at point 134 the user turns the switch OFF. The user then wits more than 8 seconds and turns the switch back ON at point 138, also shown as point 184 in FIG. 8B. At this point the level set module goes into the PROGRAM MODE and starts cycling through all 4 levels for 4 times.

FIG. 7B shows what the voltage looks like at the 0-10 VDC (+) PURPLE control wire. If you compare FIG. 7A with 7B you can see that the 0-10V signal 123 turns ON at almost the same time as the AC line is turned on 122. When the switch is turned OFF at 126 you can see that the voltage on the 0-10 VDC (+) PURPLE control wire does not drop to zero until 142 3 seconds after the switch was turned OFF. There is always some significant delay between the switch turning OFF and the drop in the 0-10V (+) terminal. To complicate matters the delay is different for every different model of LED driver.

Even though there is the 3 second delay shown in FIG. 7B at point 142, the second time the user turns the switch ON 128 and OFF 132 there is the same 3 second delay between 134 and 150. Since the LED driver is the same the delay is about the same. In the microprocessor algorithm that determines if the user turned the switch on the $1^{st}$ and $2^{nd}$ time both for 5 seconds, it looks at the total time 140 and 146 which each include the same delay and tests if they are within + or −1 sec of each other. The (+) and (−) 1 sec test is shown at 148 and 152 which are 1 sec before and after 150.

Figure 8B:
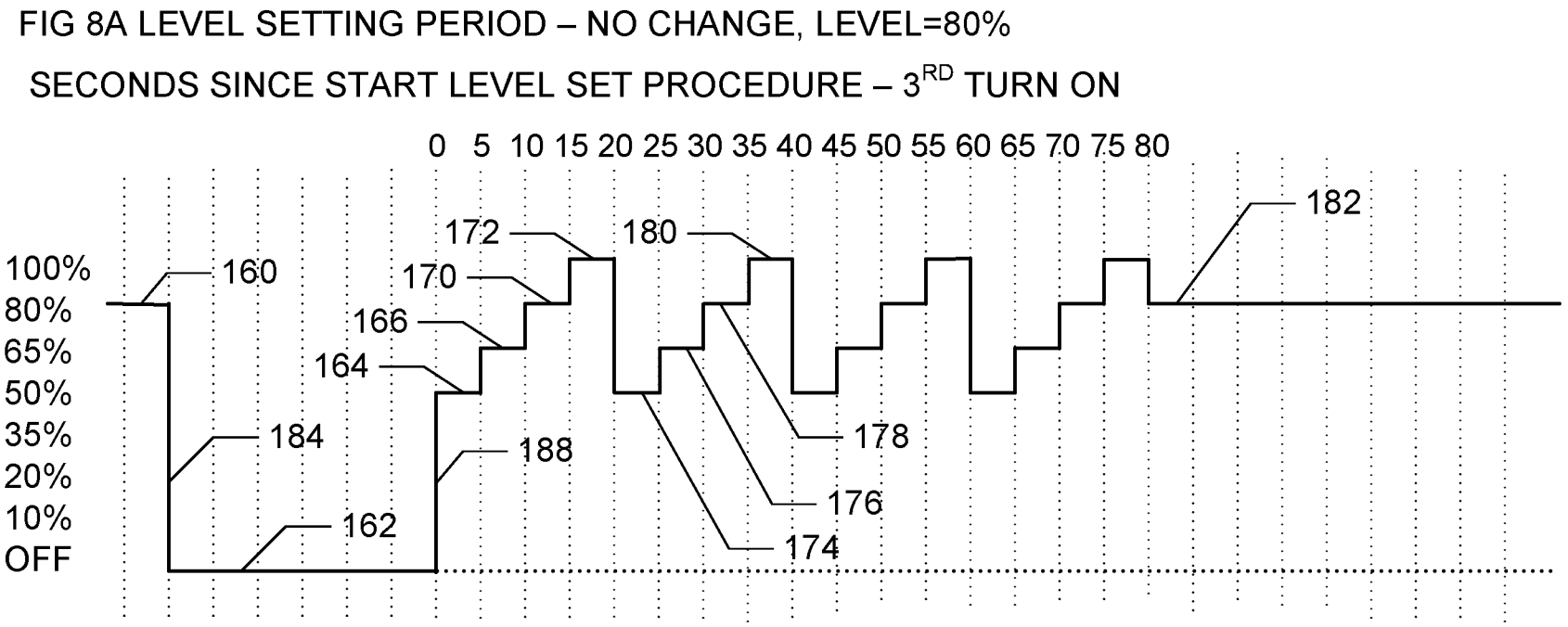
FIG. 8 LEVEL SETTING PERIOD—NO CHANGE, LEVEL=80%. This figure shows the 0-10V fixture levels once the level setting module is in level setting mode. Also shown is the wall switch ON and OFF operation required to get start and end the level setting mode of operation. In this diagram the level setting mode is allowed to time-out with no change made in the current level, which is 80%.
Figure 8B:
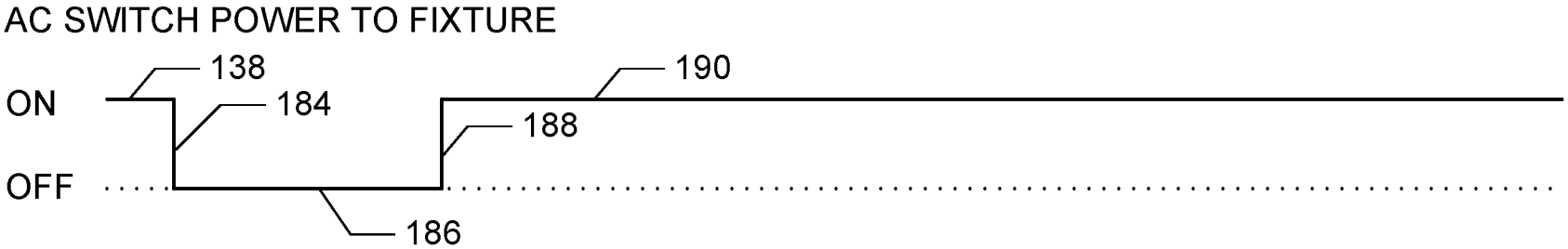
Figure 9:
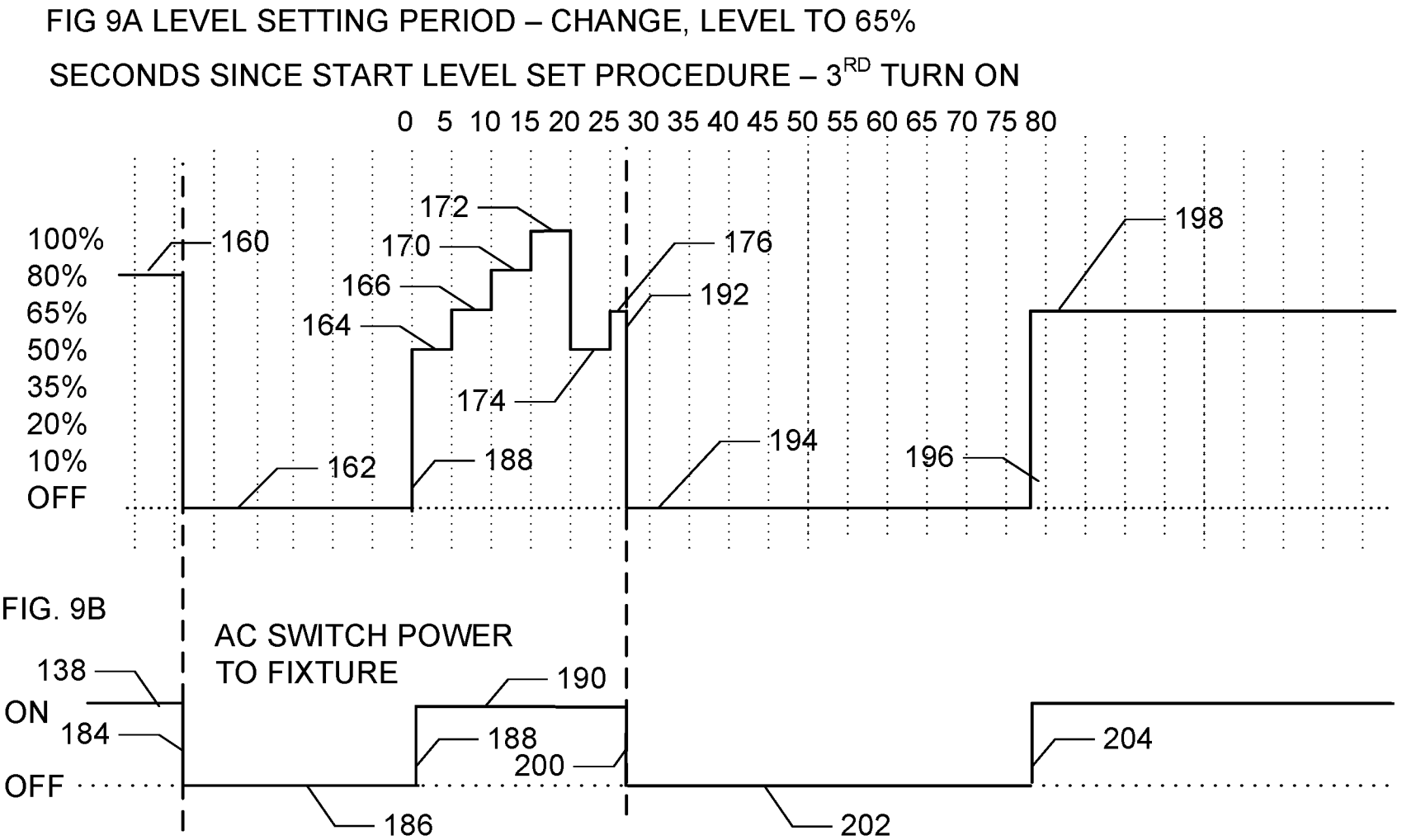
FIG. 9 LEVEL SETTING PERIOD—LEVEL CHANGED, FROM LEVEL=80% TO LEVEL=65%. This figure shows the 0-10V fixture levels once the level setting module is in level setting mode. Also shown is the wall switch ON and OFF operation required to get start and end the level setting mode of operation. In this diagram the level setting mode is terminated by the user to change made in the current level, which is 80% to the new level 65%.

FIGS. 8 and 9 show what happens to the lighting levels after the user turns the switch ON and OFF for 8 seconds two times. After that 2× ON/OFF for 8 sec is complete the $3^{rd}$ time the user turns the switch ON the level setting module enters the PROGRAM MODE shown at point 188. In FIGS. 7 and 8 the level set module was currently at level 80% shown at 160. The level setting module in PROGRAM MODE starts cycling through all 4 levels 164,166,170,172 and then again at 174,176,178,180. The level setting module goes through the 4 levels 4 times until at point 182 if the user has not turned the switch OFF the level returns at 182 to the previous level of 80%.

In FIG. 9 is the same as FIG. 7 except that the user turns the switch OFF at point 192 when the level in PROGRAM MODE was at 65%. The level setting module records the level 65% 192 it was at just before shut off and will now use that level 192 as the new normal level. When the switch is turned ON again at 196 the LED driver is now set to the 65% level at 198. The user changed normal ON level from 80% to 65%. The fixture now will always go ON to 65% until the level setting process of going into PROGRAM MODE is repeated.

This device and method are very innovative because this is the least expensive device that can be added to an existing LED fixture and allow the user to set the lighting level. This method/device will allow the user to set the lighting level on virtually all 0-10V LED drivers without having to physically open up the LED driver compartment or fixture to set a switch or dial. Also this method can change the lighting level on all the fixtures connected to a wall switch circuit at the same time. Also since the device is using the 0-10V connect for powering the microprocessor the level setting module consumes no additional power.

Figure 10:
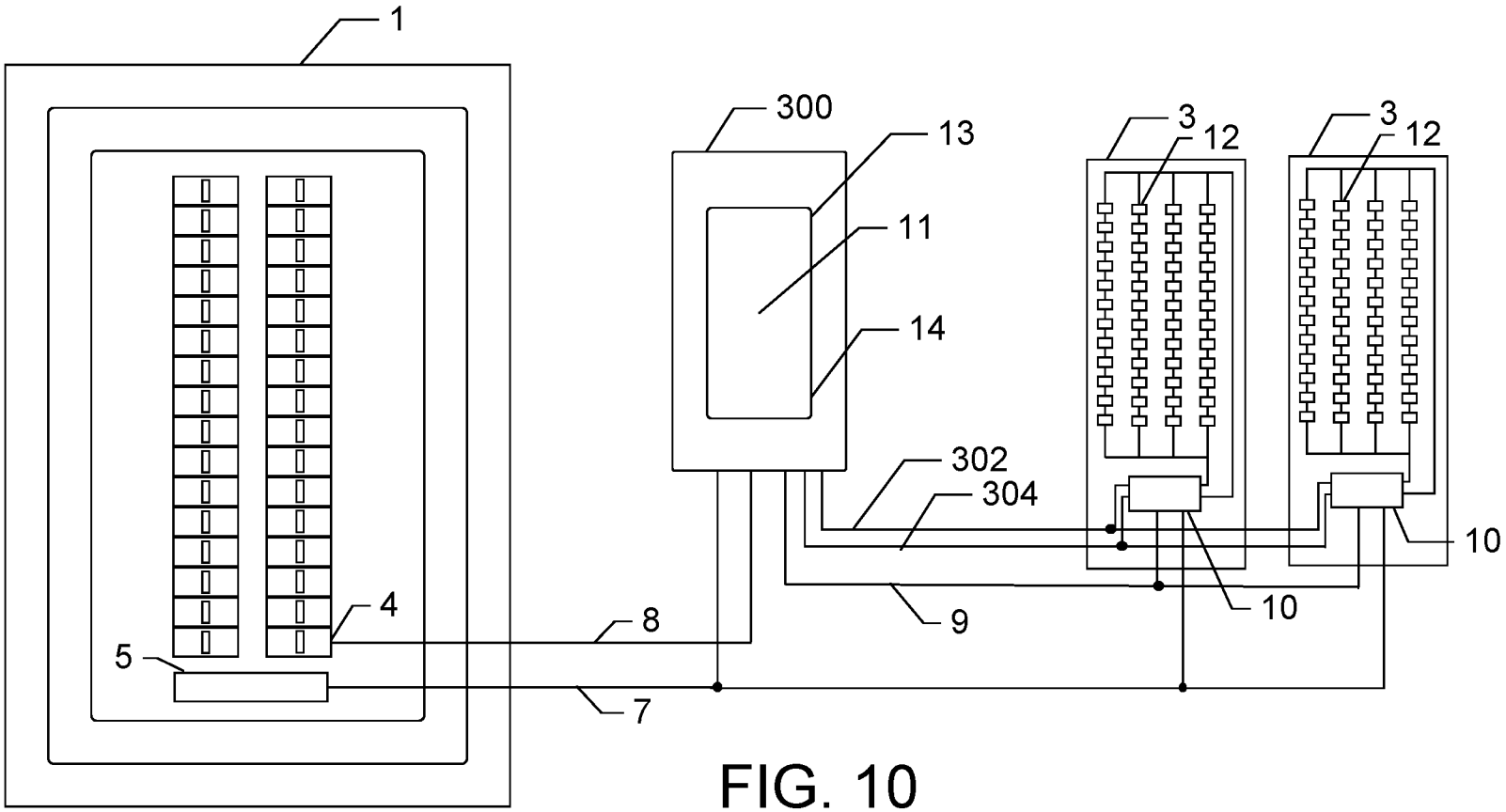
FIG. 10 PRIOR ART, TYPICAL 0-10V WIRING TO FIXTURES This figure shows the prior art of hard-wired method of controlling 0-10V drivers installed in LED fixtures.

FIG. 10 shows the most common prior art method of controlling 0-10V fixtures. This is the most common and straightforward and inexpensive method. The low voltage 0-10V wires 302 and 304 must be run from the wall switch dimmer 300 and to each of the fixtures 3. This is conceptually simple but in reality is very expensive or impossible to achieve in practical situations. In the current preferred embodiment there is no need to run additional low voltage wires or purchase a special dimmer with 0-10V isolated output control. This is a very significant improvement. This makes it practical to set the lighting level of 0-10V fixtures in any retrofit situation.

Figure 11:
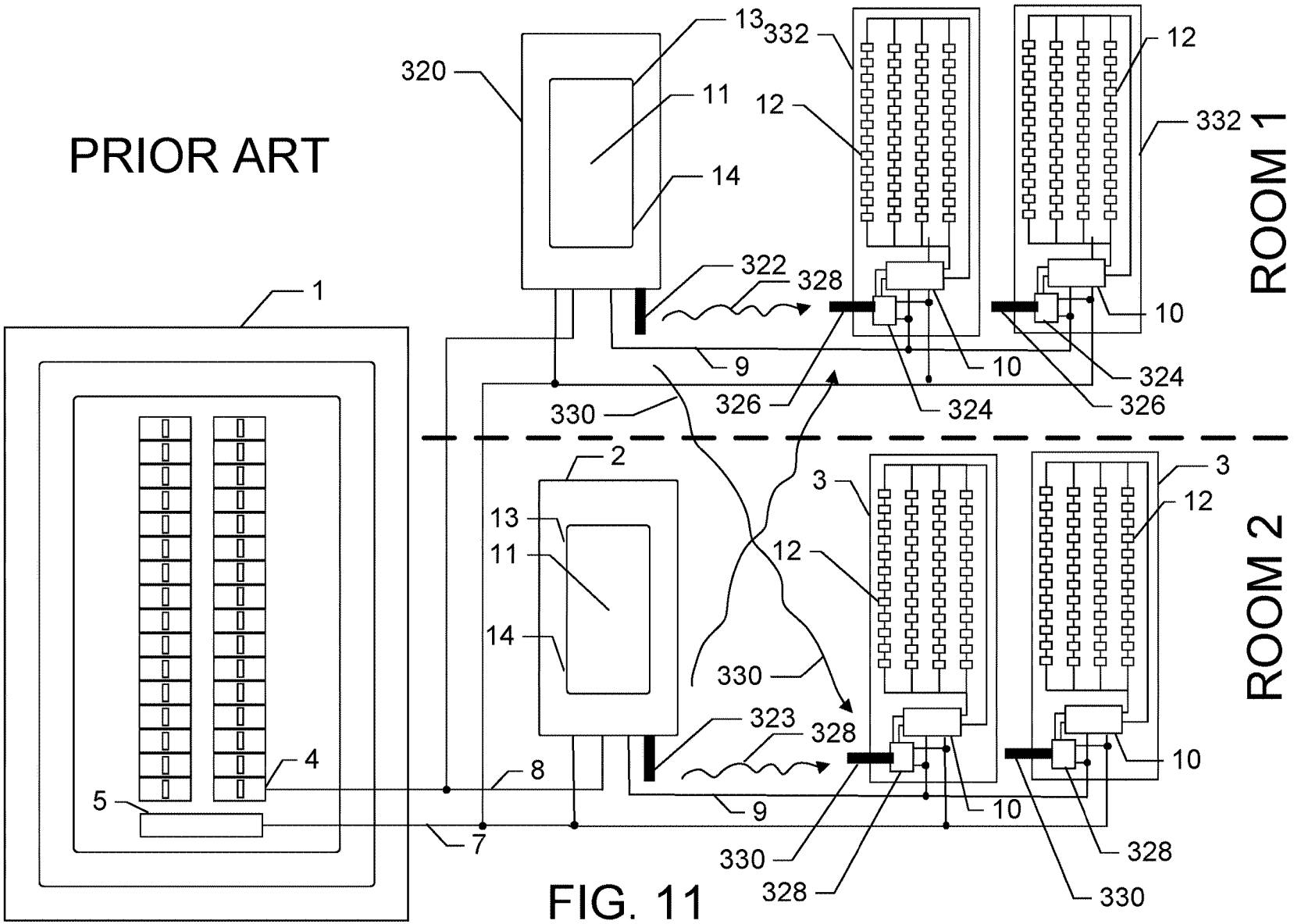
FIG. 11 PRIOR ART, TYPICAL WIRELESS CONTROL OF LED FIXTURES This figure shows the prior art of using conventional wireless control modules of 0-10V drivers installed in LED fixtures.

FIG. 11 shows a different prior art method of controlling 0-10V fixtures. This is a more expensive method that shown in FIG. 20 but removes the necessity of running low voltage wires. A special wireless transmitter and antenna 322 is installed in the dimmer and special wireless receivers 326 are installed in the fixtures 3. The wiring is identical to my FIG. 1 except for the special transmitters and receivers installed in the dimmer switch and fixtures. This is conceptually simple but much more expensive and complicated than the current preferred embodiment. Wireless communications has several key disadvantages compared to the current invention:

a. The antennas in both the transmitting devices and receiving devices have to be outside of the metal enclosure of the fixtures. This is difficult or impossible to achieve at a practical cost
b. There is a range limitation for all wireless communication often limited to 30 or 40 feet, which may be inadequate in many situations
c. There is a cost factor for wireless communication that increases the cost of the transmitting devices. The invention that is the subject of this application uses only the simple relays that are in conventional on/off control devices to transmit the messages. There are no additional costs for components or production or manufacturing. The only change needed is in the firmware of the microprocessor.
d. There is the necessity of linking transmitters to receivers so dimmers will not control all receivers and fixtures within the wireless range. In FIG. 21 it is shown how wireless transmissions 330 from dimmer 2 may unacceptably control all four fixtures in the figure including the two fixtures 332 in room 1, even though they should only control the two fixtures 3 in room 2. The only way to solve this problem is with some more complicated method of addressing or linking which involves some level of setup, configuration or programming, on-site or at the factory. The invention which is the subject of this application does not have that problem because the level setting device will only will control the fixtures on the circuit to which the fixtures are wired. There can be no cross-talk between adjacent rooms or areas.
e. The level setting modules of the current embodiment and application can be installed in any fixture with absolutely no setup or configuration or linking which is a large advantage to the designer and installer and end-user.

Figure 12:
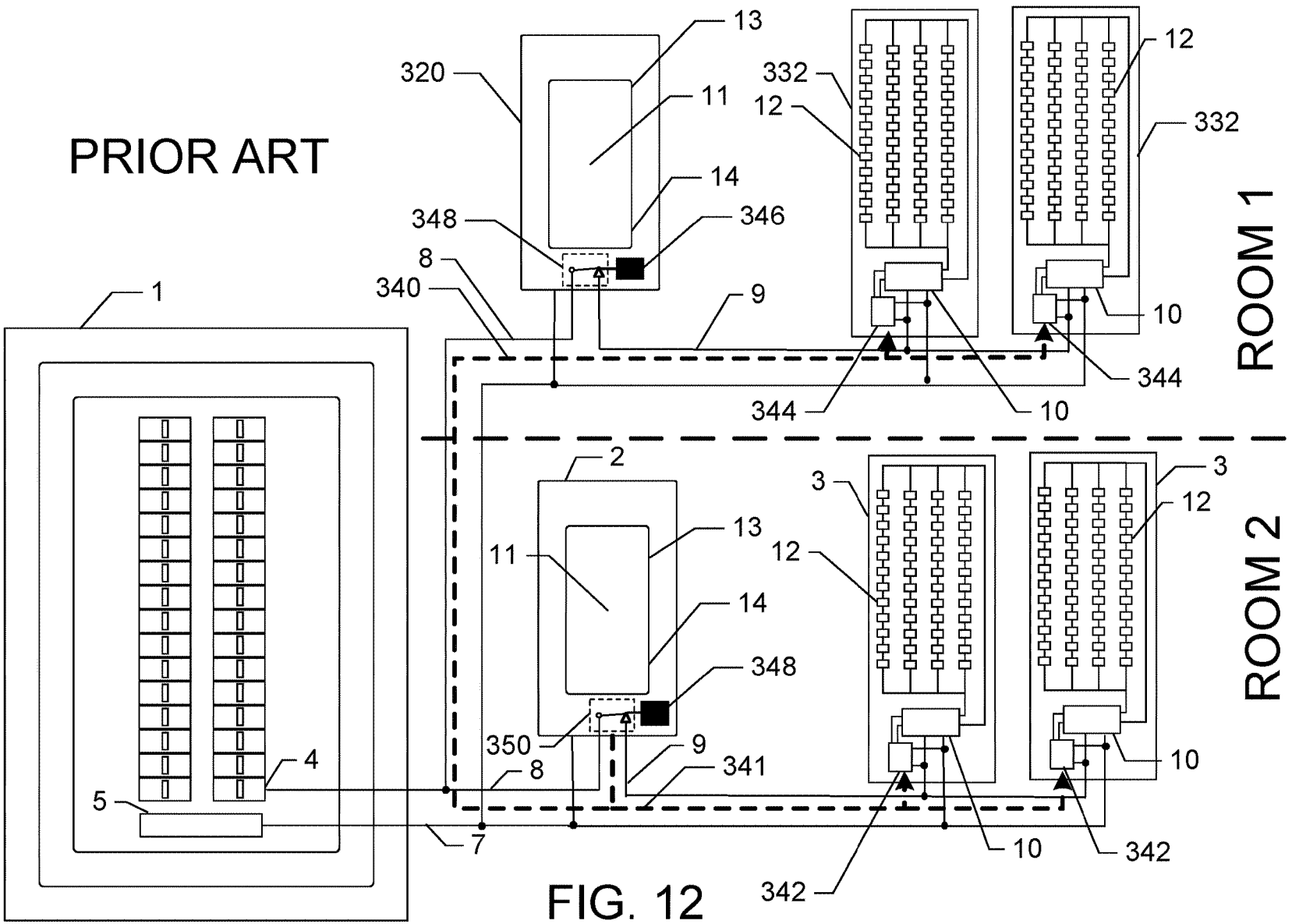
FIG. 12 PRIOR ART, TYPICAL POWERLINE CONTROL OF LED FIXTURES This figure shows the prior art of using conventional powerline communication control modules of 0-10V drivers installed in LED fixtures.

FIG. 12 shows a different prior art method of controlling 0-10V fixtures. This is a more expensive method that shown in FIG. 9 but removes the necessity of running low voltage wires. A special powerline communication transmitter 346, 348 are installed in the dimmers and special powerline receivers 342, 344 are installed in the fixtures 3, 332 which are located in two different rooms Room 2 and Room 1 respectively. The wiring is identical to my FIG. 1 except for the special transmitters and receivers installed in the dimmer switch and fixtures. This is conceptually simple but much more expensive and complicated than the current preferred embodiment. Powerline communications has several key disadvantages compared to the current invention:

a. There are many noise and attenuation issues for all conventional powerline communication that must be solved to produce reliable communication. This often involves special testing and installation of filters. To make matters worse the noise and attenuation issues can change as the customer add or changes various equipment such as variable speed motors in pumps and air handlers.
b. There is a cost factor for powerline communication that increases the cost of the transmitting devices. The invention that is the subject of this application uses only the simple relays that are in conventional on/off control devices to transmit the messages. There are no additional costs for components or production or manufacturing. The only change needed is in the firmware of the microprocessor.
c. There is the necessity of linking transmitters to receivers so dimmers will not control all receivers and fixtures within the wireless range. In FIG. 11 it is shown how powerline transmissions 340, 341 from dimmer 2 may unacceptably control all four fixtures in the figure including the two fixtures 332 in room 1, even though they should only control the two fixtures 3 in room 2. The only way to solve this problem is with some more expensive, complicated method of addressing or linking which involves some level of setup, configuration or programming, on-site or at the factory. Another method would be to install special blocking filters art each dimmer, which is impractical because of the cost and space requirements. The invention which is the subject of this application does not have that problem because the level setting modules will only control the fixtures on the circuit to which the fixtures are wired. There can be no cross-talk between adjacent rooms or areas or to other fixtures located on the same circuit breaker panel or same circuit.
d. The level setting modules of the current embodiment and application can be manufactured and installed in any fixture with absolutely no setup or configuration or linking which is a large advantage to the designer and installer and end-user.

This is a very significant improvement. This makes it practical to control and set the lighting level of 0-10V fixtures in any new or retrofit situation by taking a level setting module out of a box and installing it in the fixture, with no set-up or commissioning.

Although specific embodiments of the disclosure have been described, various modifications, alterations, alternative constructions, and equivalents are also encompassed within the scope of invention as set forth in the claims.

The specification and drawings are, accordingly, to be regarded in an illustrative rather than a restrictive sense. It will, however, be evident that additions, subtractions, deletions, and other modifications and changes may be made thereunto without departing from the broader spirit and scope of invention as set forth in the claims.

What is claimed is:

1. A lighting fixture level setting system comprising:

a. lighting control device with at least one line voltage power input connection and one line voltage output load connection;

b. one or more lighting fixtures, wherein each of said one or more lighting fixtures include a driver or a ballast having power input connections connected to said line voltage output load connection of said lighting control device;

c. said lighting control device capable of being manually activated to turn power to said one or more lighting fixtures on and off;

d. said driver or ballast having low voltage dimming input control connections that changes light level of said one or more lighting fixtures;

e. a level setting module configured to be connected to said low voltage dimming input control connections of said driver or ballast;

f. said level setting module powered from power derived only from said low voltage dimming input control connections;

g. said level setting module configured to set voltage on said low voltage dimming input control connections of said driver or ballast to one or more voltage and corresponding lighting levels other than the 100%;

h. wherein said level setting module sets the lighting level of said driver or ballast to one fixed lighting level by means of connecting a voltage clipping circuit in parallel with said low voltage dimming input control connections where said fixed lighting level is less than 100%.

2. The lighting fixture level setting system of claim 1, wherein said lighting control device is a simple mechanical wall switch.

3. The lighting fixture level setting system of claim 1, wherein said voltage clipping circuit is a zener diode.

4. The lighting fixture level setting system of claim 1, wherein said level setting module responsive to a on and off pattern produced manually by a person operating said lighting control device to change the lighting level of said drivers or ballasts to one of a plurality of possible different lighting levels.

5. The lighting fixture level setting system of claim 1, wherein said low voltage dimming input control connections of the one or more of said drivers or ballasts that are standard 0-10V low voltage dimming connections.

6. The lighting fixture level setting system of claim 1, wherein said lighting levels are approximately 50%, 65%, 80% or 100%.

7. The lighting fixture level setting system of claim 1, wherein said lighting control device is a conventional toggle switch.

8. The lighting fixture level setting system of claim 1, wherein said lighting control device is a conventional occupancy sensor with manual on/off control capability.

9. The lighting fixture level setting system of claim 1, wherein said lighting control device is a conventional timer with manual on/off control capability.

10. The lighting fixture level setting system of claim 1, wherein said level setting module is having no connections to the said line voltage power input connection and said line voltage output load connection.

11. The lighting fixture level setting system of claim 1, wherein said level setting module is isolated from the said line voltage power input connection and said line voltage output load connection.

12. The lighting fixture level setting system of claim 1, wherein said level setting module having no circuits responsive to any RF wireless signals.

13. The lighting fixture level setting system of claim 1, wherein one of said one or more voltage lighting levels is stored in non-volatile memory so that lighting level is maintained as current level after power to said lighting fixture or fixtures is turned OFF and then turned back ON.

14. A lighting fixture level setting system comprising:

a. lighting control device with at least one line voltage power input connection and one line voltage output load connection b. one or more lighting fixtures, wherein each of said one or more lighting fixtures include a driver or a ballast having power input connections connected to said line voltage output load connection of said lighting control device;

c. said lighting control device capable of being manually activated to turn power to said one or more lighting fixtures on and off;

d. said driver or ballast having low voltage dimming input control connections that changes light level of said one or more lighting fixtures;

e. a level setting module configure to be connected to said low voltage dimming input control connections of said driver or ballast;

f. said level setting module powered from power derived only from the said low voltage dimming input control connections;

g. said level setting module configured to set voltage on said low voltage dimming input control connections of said driver or ballast to one or more voltage and corresponding lighting levels other than the 100%;

h. wherein said different lighting levels are produced by said level setting module, wherein said level setting module includes a plurality of zener diodes in parallel with said low voltage dimming input control connections.

15. A lighting fixture level setting system comprising;

a) lighting control device with at least one line voltage power input connection and one line voltage output load connection;

b) one or more lighting fixtures, wherein each of said one or more lighting fixtures include a driver or a ballast having power input connections connected to said line voltage output load connection of said lighting control device;

c) said lighting control device capable of being manually activated to turn power to said one or more lighting fixtures on and off;

d) said driver or ballast having low voltage dimming input control connections that changes light level of said one or more lighting fixtures;

e) a level setting module that configured to be connected to said low voltage dimming input control connections of said driver or ballast;

f) said level setting module powered from power derived only from said low voltage dimming input control connections;

g) said level setting module configured to set voltage on said low voltage dimming input control connections of said driver or ballast to one or more fixed voltage levels and corresponding fixed lighting levels;

h) wherein said level setting module sets the lighting level of said driver or ballast to one fixed lighting level by means of connecting a voltage clipping circuit in parallel with said low voltage dimming input control connections.

16. The lighting fixture level setting system of claim 15, wherein said lighting control device is a simple mechanical wall switch.

17. The lighting fixture level setting system of claim 15, wherein said voltage clipping circuit is a zener diode.

18. A lighting fixture level setting system comprising:

a. lighting control device with at least one line voltage power input connection and one line voltage output load connection b. one or more lighting fixtures, wherein each of said one or more lighting fixtures include a driver or a ballast having power input connections connected to said line voltage output load connection of said lighting control device;

c. said lighting control device capable of being manually activated to turn power to said one or more lighting fixtures on and off;

d. said driver or ballast having low voltage dimming input control connections that changes light level of said one or more lighting fixtures;

e. a level setting module configured to be connected to said low voltage dimming input control connections of said driver or ballast;

f. said level setting module powered from power derived only from low voltage dimming input control connections;

g. said level setting module configured to set voltage on said low voltage dimming input control connections of said driver or ballast to one or more fixed voltage levels and corresponding fixed lighting levels;

h. wherein said level setting module sets the lighting level of said driver or ballast to one of a plurality of fixed lighting levels by means of connecting one of a plurality of zener diodes in parallel with said low voltage dimming input control connections.

19. The lighting fixture level setting system of claim 18, wherein said means of connecting one of a plurality of zener diodes in parallel with said low voltage dimming input control connections is a set of mechanical switches.

* * * * *